US006816002B2

(12) United States Patent
Bruck

(10) Patent No.: US 6,816,002 B2
(45) Date of Patent: Nov. 9, 2004

(54) CIRCUIT ARRANGEMENT FOR CONTROLLING A CONSTANT CURRENT THROUGH A LOAD

(75) Inventor: Juergen Bruck, Berlin (DE)

(73) Assignee: Tyco Electronics AMP GmbH (DE)

( * ) Notice: Subject to any disclaimer, the term of this patent is extended or adjusted under 35 U.S.C. 154(b) by 0 days.

(21) Appl. No.: 10/359,370

(22) Filed: Feb. 6, 2003

(65) Prior Publication Data

US 2003/0169093 A1 Sep. 11, 2003

(30) Foreign Application Priority Data

Feb. 8, 2002 (DE) ..... 102 05 194

(51) Int. Cl.[7] ..... G05F 1/10
(52) U.S. Cl. ..... 327/538; 327/542; 323/312
(58) Field of Search ..... 327/538, 541, 327/542, 543, 304; 323/310, 312, 315, 316

(56) References Cited

U.S. PATENT DOCUMENTS

| | | | | |
|---|---|---|---|---|
| 3,831,040 A | * | 8/1974 | Nanba et al. | 327/512 |
| 4,005,353 A | | 1/1977 | Yokoyama | 323/22 R |
| 4,006,400 A | | 2/1977 | Fett et al. | 323/19 |
| 5,731,696 A | | 3/1998 | Pennisi et al. | 323/313 |
| 6,259,287 B1 | * | 7/2001 | Macks | 327/143 |
| 6,316,990 B1 | * | 11/2001 | Tanizawa | 327/538 |

FOREIGN PATENT DOCUMENTS

| | | | |
|---|---|---|---|
| CH | 354125 | 6/1961 | |
| DE | 23 49 462 C3 | 4/1974 | G05F/1/56 |
| DE | 35 05 635 A1 | 8/1986 | |
| DE | 3624586 A1 | 1/1988 | G05F/1/56 |
| GB | 834367 | 5/1960 | |

OTHER PUBLICATIONS

European Search Report.

* cited by examiner

*Primary Examiner*—Tuan T. Lam
*Assistant Examiner*—Hiep Nguyen

(57) ABSTRACT

A circuit arrangement is described which provides an approximately constant current despite a fluctuating supply voltage. A first bipolar transistor having it's base-emitter path connected in series with a parallel combination of the base-emitter path of a second bipolar transistor and a second resistor. The collector voltage of the second bipolar transistor controls a third bipolar transistor as a bypass to the base-emitter path of the first bipolar transistor and opposes variation of the base-emitter voltage of the first bipolar transistor. If, for example, the base-emitter voltage of the first bipolar transistor increases as a result of a higher supply voltage, the collector current of the third bipolar transistor is increased and thus the increase in the base current of the first bipolar transistor is reduced, thereby causing negative feedback.

5 Claims, 2 Drawing Sheets

CIRCUIT ARRANGEMENT FOR CONTROLLING A CONSTANT CURRENT THROUGH A LOAD

FILED OF THE INVENTION

The invention relates to a circuit arrangement for controlling a current through a load.

BACKGROUND OF THE INVENTION

Circuit arrangements for controlling a current through a load are used in many different applications, in order, for example to apply a constant current to a load. Such circuit arrangements are used for example in the field of automobile technology, to ensure that power is supplied to various loads such as components/systems which consume power by a motor vehicle battery. To this end, circuit arrangements are known which, by electronic means, emulate a power source, generally an apparently very high voltage source with a very high internal resistance.

Known circuit arrangements measure the current flow in a suitable manner, for example by providing a measuring resistor in the load branch. The voltage drop across the measuring resistor is evaluated and an actuator is controlled as a function thereof in such a way that the voltage drop across this resistor remains as constant as possible.

In order to optimise the effective operating range of such a power source, the voltage drop across this resistor also the resistor should be as small as possible. However, this complicates evaluating the voltage drop.

A constant power source is known from DE 3 624 586 A1, which comprises a first and a second bipolar transistor. The emitter of the first transistor is connected to an input terminal by a resistor and the collector of the first transistor is connected to an output terminal. The base of the second transistor is connected to the emitter of the first transistor. The emitter of the second transistor is likewise connected to the input terminal. The collector of the second transistor is connected to the base of the first transistor. Power is supplied to the base of the first transistor across a drive resistor. The second transistor here serves as a controller and discharges the base current not required by the first transistor. Thanks to the above-described constant power source, an approximately constant current is provided at the output terminal, without the need for complex control by using an operational amplifier. However, in this circuit arrangement too, a resistor is arranged in the load circuit, which causes an additional voltage drop. In the event of a dip in the supply voltage across the input terminal, for example, this additional voltage drop leads to a premature dip in the output current across the output terminal. Thus, in the event of a short-term fall in the supply voltage, it is possible that sufficient voltage will no longer be available to supply a load reliably with constant current.

SUMMARY

An object of the invention is therefore to provide a circuit arrangement for controlling an approximately constant current, with which the voltage drop in the load circuit is reduced.

This and other objects are achieved by a circuit arrangement which provides an approximately constant current despite a fluctuating supply voltage. A first bipolar transistor having it's base-emitter path connected in series with a parallel combination of the base-emitter path of a second bipolar transistor and a second resistor. The collector voltage of the second bipolar transistor controls a third bipolar transistor as a bypass to the base-emitter path of the first bipolar transistor and opposes variation of the base-emitter voltage of the first bipolar transistor. If, for example, the base-emitter voltage of the first bipolar transistor increases as a result of a higher supply voltage, the collector current of the third bipolar transistor is increased and thus the increase in the base current of the first bipolar transistor is reduced, thereby causing negative feedback.

The invention advantageously prevents an additional voltage drop in the load circuit. The circuit arrangement allows for a virtually constant current for supplying a load even in the event of a drastic dip in supply voltage. Further advantageous embodiments of the invention are indicated in the dependent claims.

BRIEF DESCRIPTION OF THE DRAWINGS

The invention is explained in more detail below with reference to the Figures, in which.

DETAILED DESCRIPTION OF THE PREFERRED EMBODIMENTS

Figure 1:
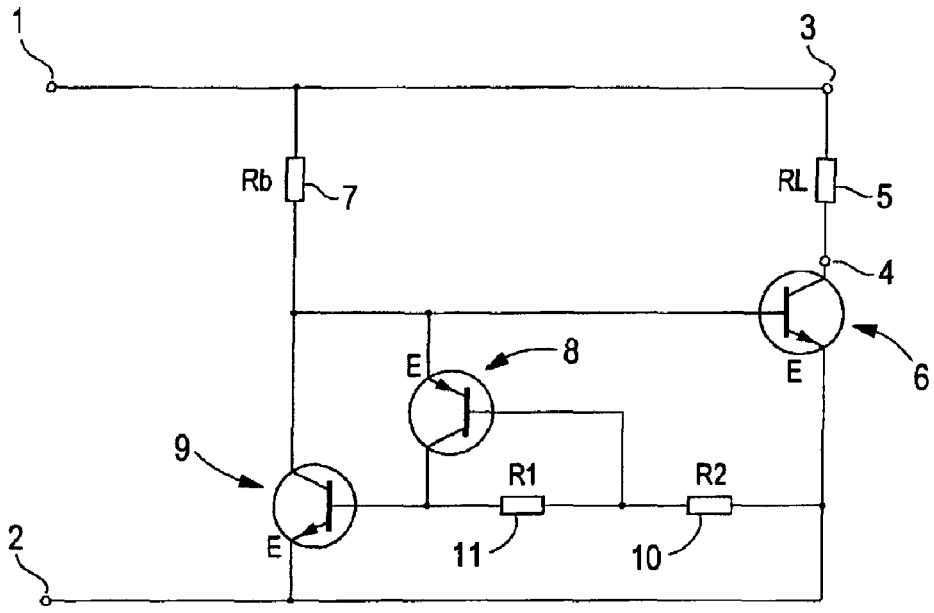
FIG. 1 shows a first embodiment of the circuit arrangement.

FIG. 1 shows a first embodiment of the circuit arrangement according to the invention for controlling a constant current through a load. The circuit arrangement may be used in various technological fields. The circuit arrangement serves to provide a power supply for a load which remains sufficient despite a low or falling voltage. This characteristic may be advantageous for example when starting an internal combustion engine, at which time the on-board voltage falls considerably and may possibly lead to relay malfunctioning.

FIG. 1 shows first and second input terminals 1, 2, which provide a supply voltage. The first input terminal 1 is connected with a first output terminal 3. A load 5 is connected to the first output terminal 3 by a first terminal. A second terminal of the load 5 is connected with a second output terminal 4. The collector terminal of a first bipolar transistor 6 is connected to the second output terminal 4. The emitter terminal of the first bipolar transistor 6 is connected with the second input terminal 2. The path through the first input terminal 1, the first output terminal 3, the load 5, the second output terminal 4 and the first bipolar transistor 6 to the second input terminal 2 constitutes a load path.

A first resistor 7 is connected to the first input terminal 1 by its first terminal. The second terminal of the first resistor 7 is connected with the base of the first bipolar transistor 6. The collector of a third bipolar transistor 9 and the emitter of a second bipolar transistor 8 are additionally connected to the base of the first bipolar transistor 6. The emitter of the third bipolar transistor 9 is connected to the emitter of the first bipolar transistor 6. The base of the third bipolar transistor 9 is connected with the collector of the second bipolar transistor 8. The base of the second bipolar transistor 8 is connected with the emitter of the first bipolar transistor 6 via a second resistor 10. The base of the second bipolar transistor 8 is additionally connected with the base of the third bipolar transistor 9 via a third resistor 11.

The circuit arrangement of FIG. 1 operates as follows: a supply voltage for supplying the load 5 is provided across the first and second input terminals 1, 2. The current flow through the load 5 is controlled by the first bipolar transistor 6. The base of the first bipolar transistor 6 is supplied with a control current across the first resistor 7. The magnitude of the current into the base of the first bipolar transistor 6 determines the magnitude of the current through the load 5. A series connection comprising the emitter-base path of the second bipolar transistor 8 and of the second resistor 10 is connected in parallel with the base-emitter path of the first bipolar transistor 6. The circuit arrangement is so dimensioned that the current density in the second bipolar transistor 8 is less than in the first bipolar transistor 6. Thus, as a rule the voltage drop over the emitter-base path of the second bipolar transistor 8 is also smaller than the voltage drop over the base-emitter path of the first bipolar transistor 6. The difference between the base-emitter voltages of the first and second bipolar transistors 6, 8 falls across the second resistor 10.

If the respective current densities in the first and second bipolar transistors 6, 8 are suitably selected, the voltage drop across the second resistor 10 amounts to only a few millivolts. If the supply voltage then changes, this leads to a current variation in the first resistor 7. Consequently, the voltage drop over the base-emitter path of the first bipolar transistor 6 also changes and with it the voltage distribution between the emitter-base voltage of the second bipolar transistor 8 and the voltage across the second resistor 10. This results in a variation in the base current and consequently in the collector current of the second bipolar transistor 8 and is converted across the third resistor 11 into a variation in the voltage across the base terminal of the third bipolar transistor 9. The resistance value of the third resistor 11 is preferably selected to be greater than the resistance value of the second resistor 10. Thus, a voltage variation across the second resistor 10 is converted into an enlarged voltage variation across the base of the third bipolar transistor 9.

Through suitable selection of the operating points, the collector voltage of the second bipolar transistor 8 is adjusted in such a way that the third bipolar transistor 9 is directly activatable. The collector current of the third bipolar transistor 9 opposes a variation in the voltage over the base-emitter path of the first bipolar transistor 6, such that negative feedback is achieved. If the voltage across the input terminal 1 increases, for example, the current through the first resistor 7 rises, which leads to an enlarged voltage drop over the base-emitter path of the first bipolar transistor 6. Consequently, the voltage drop across the second resistor 10 is also greater and thus also the voltage across the base terminal of the third bipolar transistor 9. The third bipolar transistor 9 thereby becomes more strongly conductive, such that more current flows away across the third bipolar transistor 9. This in turn leads to a smaller increase in the current through the first bipolar transistor 6. In this way, a current variation through the load 5 is reduced, but not eliminated. The magnitude of the negative feedback may be adjusted by selecting the resistance values of the second and third resistors 10, 11 appropriately.

In addition, in a preferred embodiment, the second and/or the third resistor may be used, through appropriate dimensioning of the temperature coefficients, to compensate a mismatch of the temperature coefficients of the base-emitter voltages of the three bipolar transistors.

Figure 2:
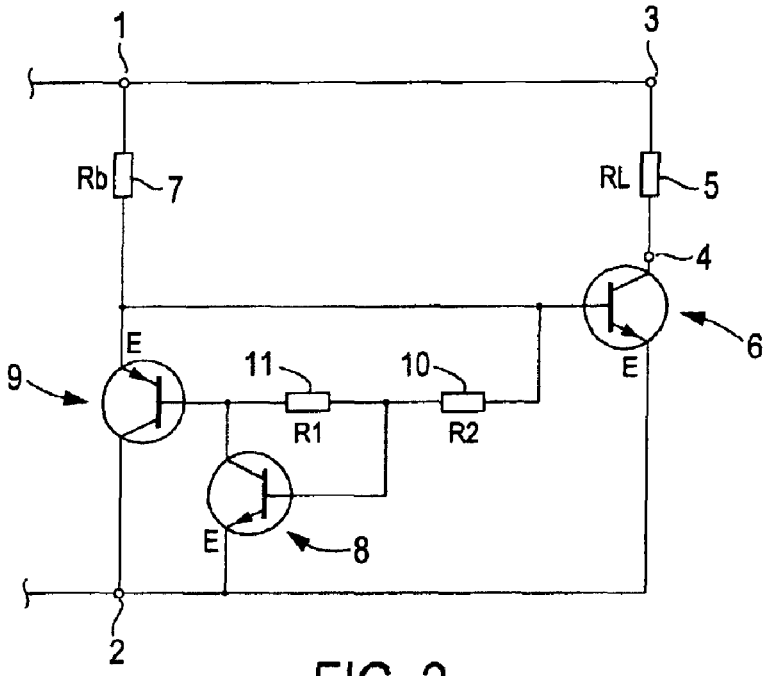
FIG. 2 shows a second embodiment of the circuit arrangement.

FIG. 2 shows another embodiment of the invention, in which the second and third bipolar transistors 8, 9 are designed with a different circuit type from FIG. 1. In FIG. 2, the third bipolar transistor 9 takes the form of a PNP transistor and the second transistor 8 the form of an NPN transistor. Due to the different circuit type, the emitter terminal of the second bipolar transistor 8 is connected in this embodiment not with the base terminal of the first bipolar transistor 6 but instead with the emitter of the first bipolar transistor 6 and the second terminal of the resistor 10 is connected with the base of the first bipolar transistor 6. Otherwise, the embodiment of FIG. 2 functions like the embodiment of FIG. 1.

Figure 3:
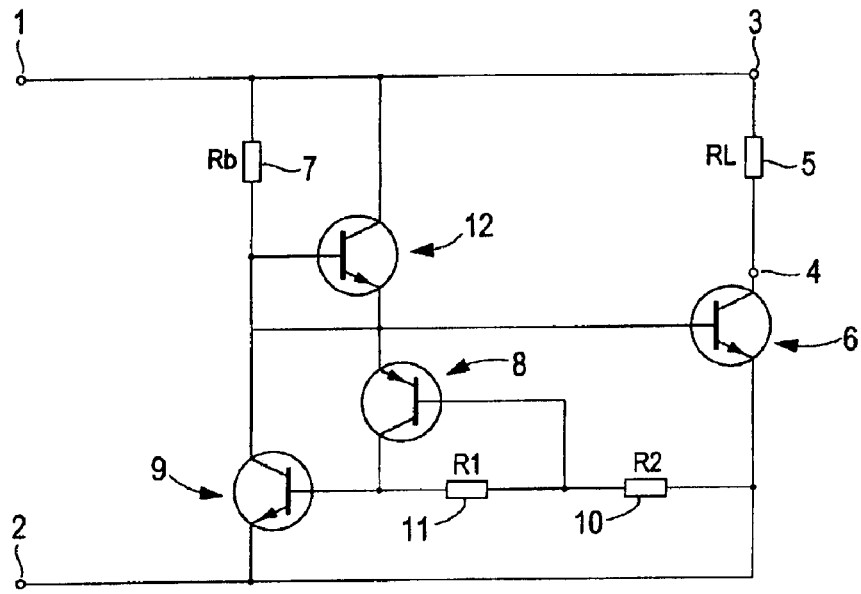
FIG. 3 shows a third embodiment of the circuit arrangement and FIG. 4 shows a fourth embodiment of the circuit arrangement.

FIG. 3 shows another embodiment of the invention, which corresponds substantially to the embodiment of FIG. 1 except, however, that a fourth bipolar transistor 12 is additionally connected between the first resistor 7 and the base terminal of the first bipolar transistor 6. The fourth bipolar transistor 12 takes the form of an NPN transistor and is connected by its collector to the first input terminal 1. The emitter of the fourth bipolar transistor 12 is connected with the base of the first bipolar transistor 6 and the emitter of the second bipolar transistor 8. The base of the fourth bipolar transistor 12 is connected with the second terminal of the first resistor 7 and with the collector terminal of the third bipolar transistor 9. The collector of the second bipolar transistor 8 is likewise connected with the base terminal of the third bipolar transistor 9 and the emitter thereof is connected with the emitter of the first bipolar transistor 6.

The circuit arrangements of FIGS. 1 and 2 exhibit the disadvantage that, in the case of a large collector current through the first bipolar transistor 6, a relatively large base current must also be provided for the first bipolar transistor 6. So that the large base current may be provided for the first bipolar transistor 6, the resistance value of the first resistor 7 has to be selected to be relatively small. In the case of a simultaneously high operating voltage across the first and second input terminals 1, 2, a small resistance value for the first resistor 7 leads to an unfavorable operating point for the third bipolar transistor 9. It is therefore advantageous to use an impedance transformer for high operating voltages. In a simple embodiment, the impedance transformer takes the form of the fourth bipolar transistor 12, the collector of which is connected with the first terminal of the first resistor 7 and the base of which is connected with the second terminal of the first resistor 7. In a corresponding manner, the emitter of the fourth bipolar transistor 12 is connected with the base of the first bipolar transistor 6 and the emitter of the second bipolar transistor 8.

Due to the arrangement of the fourth bipolar transistor 12, the first resistor 7 may have a larger resistance value. In this embodiment, the third bipolar transistor 9 merely discharges the unneeded base current of the fourth bipolar transistor 12. Otherwise, the negative feedback in FIG. 3 operates as in the embodiment of FIG. 1.

Figure 4:
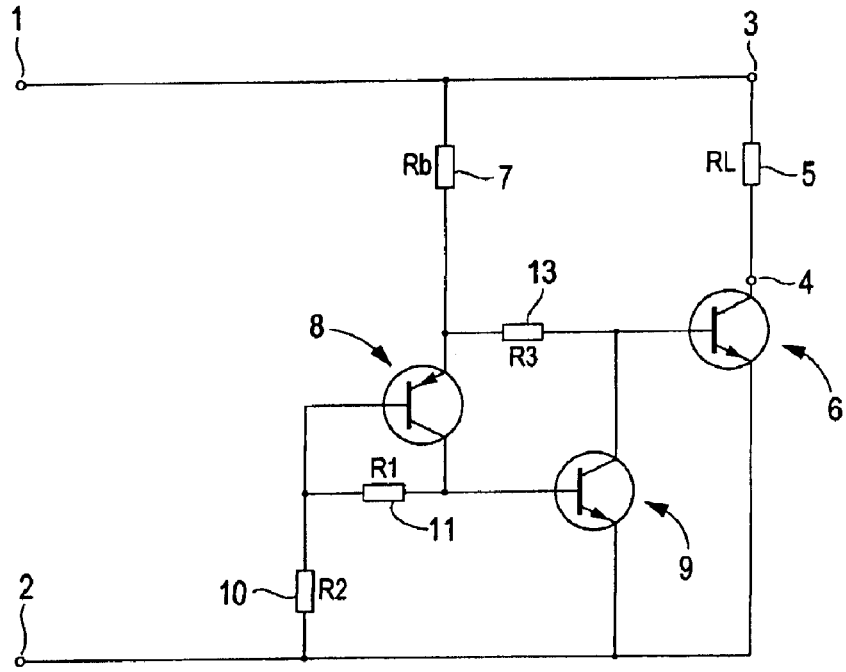

FIG. 4 shows another improved embodiment of the circuit arrangement according to the invention which is constructed substantially like FIG. 1 except, however, that the second terminal of the first resistor 7 is connected with the emitter of the second bipolar transistor 8 and a fourth resistor 13 is connected between the emitter of the second bipolar transistor 8 and the base of the first bipolar transistor 6. Furthermore, the collector of the third bipolar transistor 9 is connected directly with the base of the first bipolar transistor 6. All the previous circuit arrangements shown in FIGS. 1 to 3 reduce the modulation of the base-emitter voltage of the first bipolar transistor 6 in the event of fluctuating operating voltage across the input terminals 1, 2 by means of negative feedback across the third bipolar transistor 9, without full compensation thereof.

The fourth resistor 13 according to the embodiment of FIG. 4 allows not only the undesired base current of the first bipolar transistor 6 to be discharged across the third bipolar transistor 9 but also, at the same time, additional control of the base-emitter voltage of the first bipolar transistor 6. Control of the base-emitter voltage of the first bipolar transistor 6 is effected by a voltage drop across the fourth resistor 13. The fourth resistor 13 is small relative to the second and third resistors 10, 11. Through suitable dimensioning, it is possible to keep the collector current of the first bipolar transistor 6 virtually constant over a wide supply voltage range.

The embodiments of FIGS. 1 to 4 are not tied to the bipolar transistor embodiments illustrated, but may also be constructed with bipolar transistors of other circuit types. Depending on the selected dimensioning of the components, it is possible to keep the current constant in the event of a defined variation in the voltage across the input terminals 1, 2 and for a defined period after the voltage variation.

What is claimed is:

1. A circuit arrangement for controlling a current through a load comprising:

a first and a second input terminal for connection of a supply voltage;

a first and a second output terminal for connection of a load wherein the first output terminal is connected to the first input terminal;

a first bipolar transistor, having a collector connected to the second output terminal, an emitter connected to the second input terminal and a base forming a base-emitter path;

a first resistor, having a first terminal connected with the first input terminal and a second terminal connected with the base of the first bipolar transistor;

a control circuit having a first terminal connected to the base of the first bipolar transistor and a second terminal connected to the emitter of the first bipolar transistor for evaluating the base-emitter voltage of the first bipolar transistor;

the control circuit forming a bypass to the base-emitter path of the first bipolar transistor and branching the current through the first resistor such that the base current of the first bipolar transistor is virtually independent of the supply voltage across the input terminals, wherein the control circuit comprises a second and a third bipolar transistor each having an emitter, a collector and a base, the emitter of the second bipolar transistor being connected with the emitter of the first bipolar transistor the base of the second bipolar transistor being connected with a first terminal of a second resistor, whose second terminal is connected with the base of the first bipolar transistor, the collector of the second bipolar transistor being connected with a first terminal of a third resistor, whose second terminal is connected with the base of the second bipolar transistor, the collector of the second bipolar transistor being connected with the base of the third bipolar transistor, the emitter of the third bipolar transistor being connected with the base of the first bipolar transistor, and the collector of the third bipolar transistor being connected with the emitter of the first bipolar transistor, such that the second bipolar transistor is the same circuit type as the first bipolar transistor.

2. A circuit arrangement according to claim 1 wherein the third resistor has a larger resistance value than that of the second resistor.

3. A control circuit being connectable across a base emitter junction of a first bipolar junction transistor (BJT) supplying a load between its collector and an input terminal, the control circuit comprising:

a second bipolar junction transistor (BJT) having an emitter connected with an emitter of the first BJT;

a first resistor having a first terminal connected to a base of the second BJT and a second terminal connected to a collector of the second BJT;

a third bipolar junction transistor (BJT) having a base connected to the collector of the second BJT, a collector connected to the emitter of the second BJT and an emitter connected to a base of the first BJT; and, a second resistor having a first terminal connected to the base of the second BJT and a second terminal connected to the base of the first BJT.

4. A circuit arrangement according to claim 3 wherein the second resistor has a larger resistance value than that of the first resistor.

5. A circuit arrangement according to claim 3 further comprising a third resistor having a first terminal connected to the input terminal and a second terminal connected to the emitter of the third BJT.

* * * * *